United States Patent [19]

Schnall et al.

[11] 4,315,736

[45] Feb. 16, 1982

[54] PIVOTAL SWING-OUT FUSER ASSEMBLY FOR COPYING APPARATUS

[75] Inventors: Günther Schnall, Eching; Klaus Aldenhoven, Unterpfaffenhofen; Hanns Blöchl, Unterhaching, all of Fed. Rep. of Germany

[73] Assignee: AGFA-Gevaert AG, Leverkusen, Fed. Rep. of Germany

[21] Appl. No.: 845,453

[22] Filed: Oct. 25, 1977

[30] Foreign Application Priority Data

Oct. 28, 1976 [DE] Fed. Rep. of Germany ..... 2649018

[51] Int. Cl.[3] ..... H05B 1/00; F27B 9/28

[52] U.S. Cl. ..... 432/59; 432/60

[58] Field of Search ..... 432/59, 60, 228, 8, 432/227; 219/469, 216; 271/273, 274

[56] References Cited

U.S. PATENT DOCUMENTS

| | | | |
|---|---|---|---|
| 2,840,847 | 7/1958 | Danser | 16/163 |
| 3,007,737 | 11/1961 | Lichter | 16/163 |
| 3,498,592 | 3/1970 | Moser et al. | 432/59 |
| 3,781,517 | 12/1973 | Skamra | 432/227 |
| 3,907,492 | 9/1975 | Draugelis et al. | 432/59 |
| 4,095,311 | 6/1978 | Janosch | 16/163 |

*Primary Examiner*—Henry C. Yuen

*Attorney, Agent, or Firm*—Michael J. Striker

[57] ABSTRACT

A copying apparatus has imaging equipment provided along the upstream end of a transport path for a copying sheet through its housing, and a fuser assembly including a fuser casing and a fuser heater downstream of this imaging equipment along the path. The entire fuser assembly is pivotal about a horizontal pivot in the housing from an operative position with the heater facing downwardly toward the conveyor path to a servicing position with the fuser assembly completely outside the housing and the fuser heater facing upwardly for servicing.

1 Claim, 1 Drawing Figure

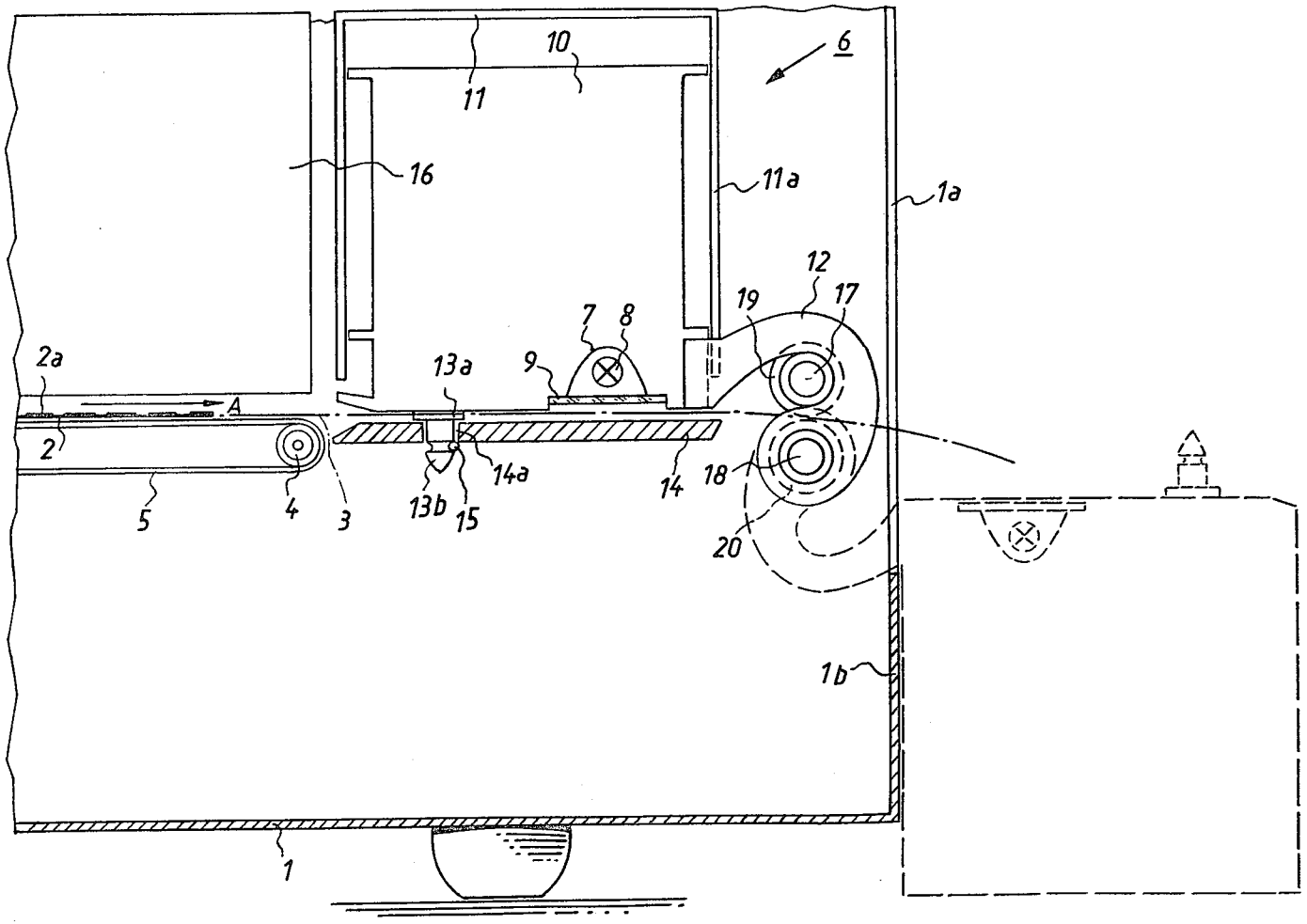
1a
6
11a
10
11
16
12
17
19
18
20
14
8
7
9
14a
13a
15
13b
3
4
A
5
2a
2
1b
1

PIVOTAL SWING-OUT FUSER ASSEMBLY FOR COPYING APPARATUS

BACKGROUND OF THE INVENTION

The present invention relates to a copying apparatus. More particularly this invention concerns a fuser assembly for such an apparatus.

A copying apparatus of the xerographic type typically has a housing provided with conveyor means which define a transport path. An imaging arrangement, typically in the form of a selenium-coated drum and appropriate optical and toner-applying equipment, is provided at an upstream imaging station along this path, and a fusing assembly, typically comprising a radiant heater, is provided at a fusing station downstream of the path. The conveyor means transports a copy sheet along the path, so that the imaging equipment can form a toner image on the copy sheet and thereafter the downstream fusing assembly can fuse this image. Such an arrangement is described in U.S. Pat. No. 3,219,326 whose entire disclosure is herewith fully incorporated by reference.

It is standard in such systems to form the conveyor path underneath the fuser assembly of a heat-resistant belt on which the copy sheet lies as it is passed through the fuser station. Thus, the radiant heater is directed downwardly at the copy sheet at a slight spacing above the belt on which it lies.

A typical problem with such assemblies is that it is necessary frequently to service the fuser assembly. As the fuser heater itself is frequently a quartz heater that shines through a transparent window onto the copy sheet, so that the copy sheet cannot directly contact the heater, it is necessary to clean this window. Furthermore, paper jams, which can occur anywhere along the conveyor path, frequently occur at the fusing station where the copy is not pinched between rollers or the like, but where it is merely lying on the transport belt so that an upturned edge or corner can catch on surrounding structure and jam in the machine.

Thus, it is frequently necessary to open up the machine and gain access to the conveyor path at the fuser station, and to gain access to the fuser heater itself. This can be done simply by leaving the edge of the conveyor path exposed, and by making the fuser heater removable in a direction perpendicular to the direction of travel of the sheet along the path. As suggested in the above-mentioned patent, it is also possible to mount the entire fuser assembly on rails extending perpendicular to the above-mentioned direction of travel. Thus, this entire fuser assembly can be slid, drawer-fashion, out of the machine for servicing of the fuser parts or clearing of a paper jam.

Such an arrangement has certain advantages, but nonetheless leaves the fuser assembly, when pulled out of the machine, in a position where servicing it is still somewhat difficult. What is more access can only be gained to the conveyor path, which is exposed when the fuser assembly is pulled out, by reaching over and past the fuser assembly. Finally, if the paper jam occurs directly under the fuser, such transverse pulling-out of the fuser assembly will only worsen the paper jam, crumpling the jammed paper up under the fuser and perhaps even damaging the delicate mechanism of the arrangement.

SUMMARY OF THE INVENTION

It is therefore an object of the present invention to provide an improved copying apparatus.

Another object of this invention is to provide an improved arrangement for mounting the fuser assembly in a copying apparatus as described in above-cited U.S. Pat. No. 3,219,326.

A further object is the provision of such an improved copying apparatus where the fuser heater is easily serviced when in the servicing position, and wherein displacement of the fuser assembly from the operative position inside the machine to the service position outside the machine is not likely to damage a copy sheet in the machine at the fuser station.

These objects are attained according to the invention by providing a pivot on the housing of the apparatus defining in turn a fixed pivot axis. Means such as mounting arms is provided between the pivot and the casing of the fuser assembly for pivoting of this fuser assembly between an operative position inside the housing with the heater juxtaposed with the path and a service position outside the housing with the heater remote from the path and positioned for servicing.

Thus with a system according to the present invention the fuser assembly need merely be pivoted out of the housing of the apparatus. Since this operation must frequently be done while the fuser still remains very hot, much too hot to touch, the problem of where to place this element does not present itself as it remains fixed to the machine housing. Furthermore, it is not necessary to undo the electrical connections between the fuser assembly and the housing when it is moved from the operative to the service position, as the various connecting wires can simply be made flexible enough to permit such pivoting without their disconnection.

According to this invention the pivot axis extends transverse to the transport direction and lies downstream of the fusing station, in a position between the fusing assembly in the operative position and the fusing assembly in the service position. The fusing assembly is pivoted through between 160° and 200°, pivoting upwardly out of the operative position toward the service position. Such pivotal motion of the fuser assembly ensures that a paper jam at the fuser station can be easily cleared, since the fuser assembly will move away from such paper jam when displaced into the service position.

In accordance with yet another feature of this invention the casing of the fuser assembly is connected via a pair of arms flanking the transport path with a pivot axle that is the pivot axle for a downstream pincher transport roller constituting a downstream portion of the conveyor means. Furthermore, a spacer is provided for defining the operative position of the fuser assembly, and an abutment is provided on or is constituted by the housng of the copying apparatus for defining the service position thereof. In this service position the normally downwardly directed heater is directed upwardly so that servicing of it is an extremely simple task. What is more, since the heater can remain connected up in this service position it is possible to test it while still connected to the machine.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The sole FIGURE of the drawing is a vertical section through an apparatus according to the instant invention.

SPECIFIC DESCRIPTION OF A PREFERRED EMBODIMENT

A copying apparatus such as described in above-mentioned U.S. Pat. No. 3,219,326 has a housing 1 provided with imaging equipment 16 that forms a toner image 2*a* on a copy sheet 2 being passed through the machine along a transport path 3 in the direction A by transport means here shown to include beneath the imaging station of the equipment 16 a belt 5 spanned at its downstream end over a roller 4, and underneath the fusing station of fusing equipment 6 of a plate 14. Downstream of the plate 14 the conveyor means further includes a pair of rubber-coated pinch rollers 19 and 20 carried on respective shafts 17 and 18 extending parallel to each other horizontally and perpendicular to the direction A. The fusing equipment 6 generally comprises an open-ended casing 10 having an upper wall 11 and a pair of side walls 11*a* extending perpendicular to the direction A. Extending horizontally and perpendicular to the direction A in the casing 10 is an infrared quartz heater 8 received in a downwardly directed parabolic-section elongated reflector 7 above a quartz sheet 9. Thus, the heat radiation from the heater 8 will be reflected downwardly on a sheet 2 passing underneath it along the path 3 so as to fuse the toner image 2*a* onto the paper 2.

In accordance with this invention the casing 10 has a pair of C-shaped arms 12 (one shown) each fixed to the casing 10 and pivoted on the axle 18 of the lower output roller 20. In addition the end wall 1*b* of the housing 1 is formed with a large throughgoing hole 1*a* which may be covered by a door having an output slot and paper receptacle during operation of the machine. The casing 10 is also provided to each side of the path 3 with a spacer 13*a* having a pin 13*b* extending through a respective hole 14*a* in the plate 14. Springs 15 snap into grooves formed in these pins 13*b* so as releasably to hold the entire fuser assembly 6 in place in the operative position shown in solid lines in the drawing.

In order to service the assembly 6 or to clear up a paper jam at the fusing station, the entire casing 10 is tipped from the solid-line position defined by the spacers 13*a* into the dashed-line position with the side wall 11*a* resting against the side wall 1*b* of the housing 1. Thus, the entire fuser assembly 6 passes through almost exactly 180°. In the dashed-line service position the upwardly turned glass 9 can readily be cleaned and any paper jammed up on the plate 14 can also readily be removed. The wires connecting the heater 8 to the control circuits of the machine need merely be flexible enough to permit such pivoting through 180° so that the entire assembly need not be disconnected, even temporarily.

It will be understood that each of the elements described above, or two or more together, may also find a useful application in other types of machines differing from the types described above.

While the invention has been illustrated and described as embodied in a copying apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a copying apparatus having a housing and wherein a copy sheet bearing a toner image moves in a path past a heater of a fuser assembly to fix said image, the improvement comprising pivot means defining on said housing a spatially fixed pivot axis; and means between said pivot means and said fuser assembly for pivoting of the latter about said spatially fixed pivot axis between an operative position in which the fuser assembly is located inside the housing and said heater is juxtaposed with said path, and a servicing position in which the fuser assembly is located outside the housing and said heater is remote from said path and positioned for servicing, wherein said means for pivoting includes at least one arm connected between said fuser assembly and said pivot, said apparatus further comprising at least one transport roller for said sheet downstream on said path from said fuser assembly in said operative position thereof, said roller being rotatable about said pivot axis and constituting said pivot.

* * * * *